US005588735A

United States Patent [19]

Harada

[11] Patent Number: 5,588,735

[45] Date of Patent: Dec. 31, 1996

[54] STICK

[76] Inventor: Noboru Harada, 2-25-11, Chuo, Edogawa-ku, Tokyo, Japan

[21] Appl. No.: 443,670

[22] Filed: May 18, 1995

[30] Foreign Application Priority Data

Jun. 14, 1994 [JP] Japan ..... 6-154334

[51] Int. Cl.[6] ..... A45B 3/04

[52] U.S. Cl. ..... 362/102; 362/184; 362/276; 362/802; 135/910; 315/159

[58] Field of Search ..... 362/102, 184, 362/802, 293, 276; 135/65, 66, 78, 910, 911; 315/159, 362, 76, 33; 340/573, 574, 692

[56] References Cited

U.S. PATENT DOCUMENTS

| | | | |
|---|---|---|---|
| 1,158,943 | 11/1915 | Lowden | 135/78 |
| 1,509,157 | 9/1924 | Leaño | 362/102 |
| 1,595,023 | 8/1926 | Probe | 362/102 |
| 3,634,885 | 1/1972 | Barkley | 340/692 |
| 4,099,535 | 7/1978 | Hubachek | 362/102 |
| 5,097,856 | 3/1992 | Chi-Sheng | 135/911 |
| 5,331,990 | 7/1994 | Hall et al. | 362/102 |
| 5,351,704 | 10/1994 | Hunnicutt, Jr. et al. | 362/102 |

FOREIGN PATENT DOCUMENTS

| | | | |
|---|---|---|---|
| 114929 | 8/1984 | European Pat. Off. | 135/911 |
| 5054974 | 3/1993 | Japan | 315/362 |

*Primary Examiner*—Ira S. Lazarus
*Assistant Examiner*—Sara Sachie Raab
*Attorney, Agent, or Firm*—Rothwell, Figg, Ernst & Kurz

[57] ABSTRACT

A stick includes a power source battery; an illuminating light source for illuminating an area close to the feet of a user; a warning light source for giving attention to a third person; a wide angle lens serving as a cover disposed on the front surface of each of the light sources; and a control circuit for supplying a drive signal to each light source by switching thereby opening/closing a feed line from the power source battery. The stick may further include an alarm activated on the basis of the above drive signal. With this stick, it becomes possible to make easy the walking in day or night, to avoid a danger and accident, and to rapidly and positively generate an alarm in the worst case where there happens a danger or accident.

2 Claims, 14 Drawing Sheets

STICK

BACKGROUND OF THE INVENTION

1. Field of the Invention

The present invention relates to a stick used as a walking-aid serving as crime prevention upon walking in day or night.

2. Description of the Related Art

A person who walks along a dark road in night feels depressed, and a driver on a bicycle or in a car passing through the road is difficult to find the walker unless being close to him, with a result that there sometimes happens an accident. Hence, a person who walks in night usually has a flashlight for illuminating an area closed to his feet, and also he has an alarm in case of a danger or accident.

On the other hand, an aged or disabled person uses a stick as a walking-aid. The stick is generally formed of a bar having a specified length, and is used only for supporting the body of the walker.

The prior art stick having the above construction is only adapted to support the body of the walker. When an aged or disabled person walks along a dark road in night, he has a stick in one hand and a flashlight in the other hand, thus causing a problem in that the walker becomes extremely instable in walking because both the hands of the walker are full up. Even when he carries an alarm, since the alarm is put in a pocket of a suit of clothes or in a bag, it is difficult to take out the alarm and activate it immediately when there happens a danger or accident.

SUMMARY OF THE INVENTION

To solve the above-described prior art problems, the present invention has been made, and an object of the present invention is to provide a stick effective to improve a safety of a user upon walking in day or night.

To achieve the above object, according to the present invention, there is provided a stick including an illuminating light source and a warning light source, wherein a drive signal is supplied from a control circuit to the illuminating light source and the warning light source by closing a switch. With this construction, the illuminating light source continuously lights and illuminates an area close to the feet of the user by way of a light diffusive lens, thereby allowing the user to easily walk in night; and the warning light source periodically flickers and gives attention to a driver, on a bicycle or in a car, facing to the user by way of a transparent cover, thereby allowing the user to walk safely along a dark road in night.

In the above stick, the handle portion may be removably connected to the upper end of the bar by screwing a fastening ring rotatably formed on one of the handle portion and the upper end of the bar with a thread portion formed on the other of the handle portion and the upper end of the bar. With this construction, there is generated no torsion of a lead wire connecting batteries contained in the bar to electric parts provided in the handle portion because each of the bar and the handle portion is not rotated upon mounting/dismounting.

In the above stick, the handle portion may be divided into two parts, whereby electric parts provided in the handle portion can be easily checked or exchanged.

In the above stick, a vibration generating source activated in interlocking with the lighting of each light source may be provided in the handle portion. With this construction, in the case where a blind person uses the stick, he can easily sense the lighting of the light source.

In the above stick, there may be provided a warning function, wherein when the user cannot walk safely in day or night, both a warning sound and the flicker of red light are simultaneously generated for rapidly informing a third person of the trouble. Specifically, the user pushes a warning switch provided near the handle portion for generating the flicker of light, thereby achieving the self-defence. Alternatively, when the user meets with a danger or accident upon walking in night, he closes the warning switch and activates an alarm, thereby simply and rapidly informing a third person of the generation of an emergence.

In the above stick, a switch operating button may be provided in the vicinity of the handle portion of the bar usually grasped by the user in hand, whereby even when the user suddenly meets with a danger or accident, he positively closes the switch and activates an alarm, thereby informing a third person of the generation of an emergence; the warning light source may be provided at a high position in the vicinity of the handle portion, whereby a third person facing to the user easily find the user, thus preventing the generation of an accident; the illuminating light source may be provided at a position having a specified height from the ground, whereby a specified area ahead of the user can be usually illuminated by the light from the illuminating light source; and a wide angle lens may be used as the transparent cover of each light source, whereby the user can walk safely in night.

In the above stick, a drive signal may be outputted from the control circuit on the basis of an AND logic of an output signal from each of a brightness sensor and a sensible sensor. With this construction, when the handle portion of the stick is grasped by the hand of the user in night, both the illuminating light source and the warning light source are allowed to automatically light and flicker, and accordingly, this stick is effective for an aged or disabled person who is difficult to positively operate the switch operating button. In this stick, since a current is allowed to flow only upon use in night, the power source battery can be prevented from being uselessly consumed due to the careless lighting of the light source in day. Moreover, since the stick does not require any mechanical switch, the construction can be simplified.

PREFERRED EMBODIMENTS OF THE INVENTION

Figure 1:
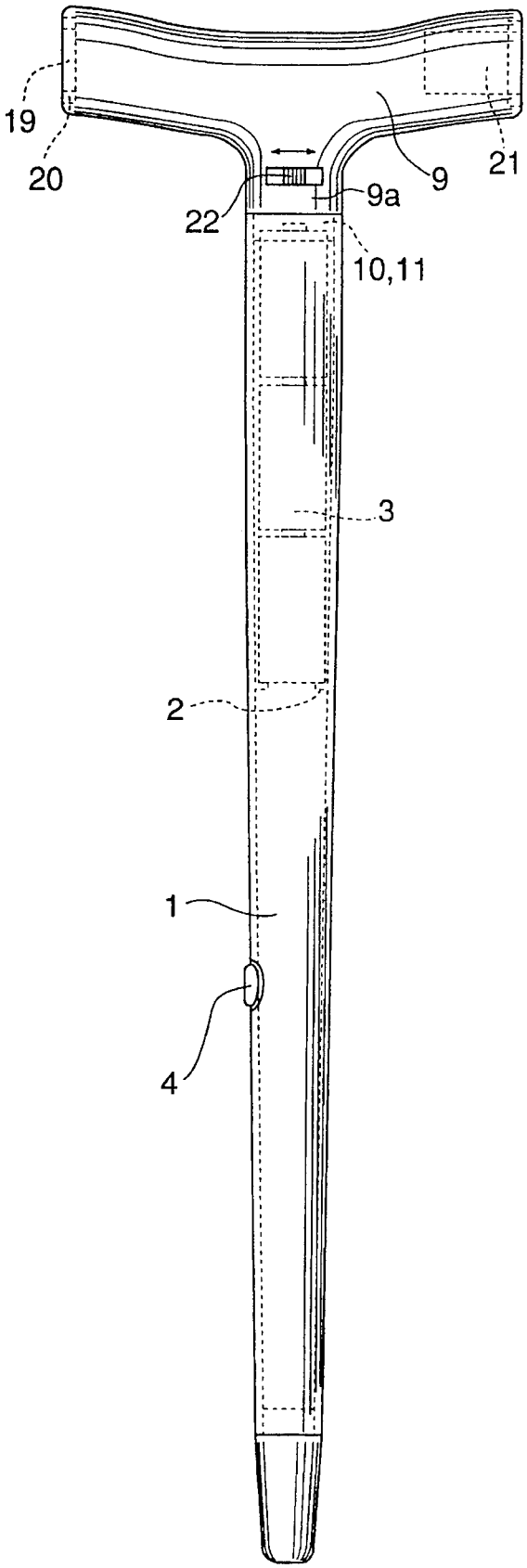
FIG. 1 is a side view showing a stick according to one embodiment of the present invention.
Figure 2:
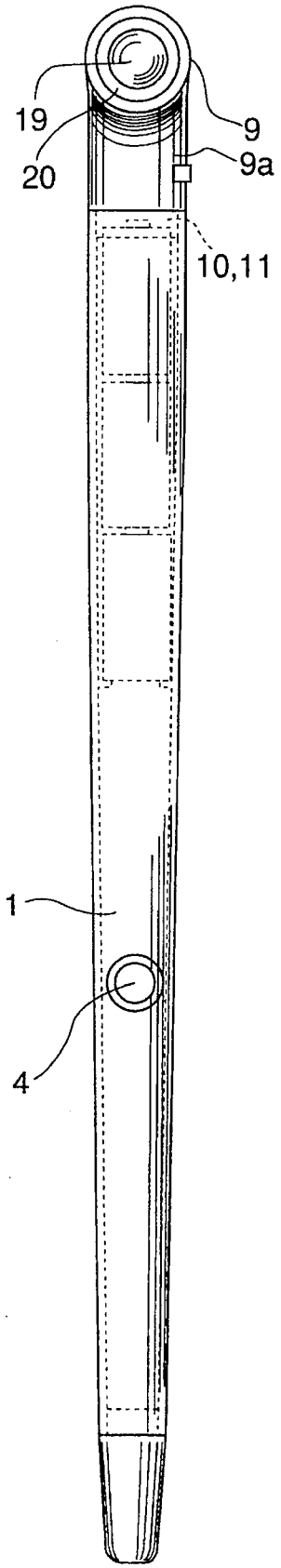
FIG. 2 is a front view of FIG. 1.
Figure 3:
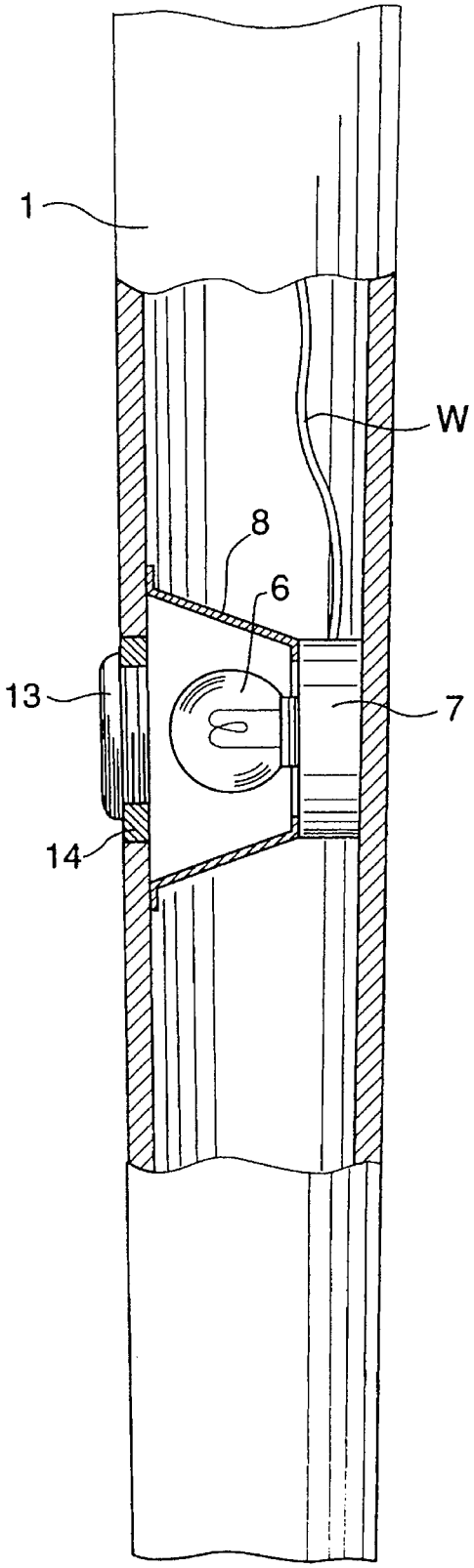
FIG. 3 is an enlarged sectional view of a portion for mounting an illuminating light source.

Hereinafter, one embodiment of the present invention will be described with reference to FIGS. 1 to 12. In FIGS. 1 and 2, reference numeral 1 indicates a cylindrical bar formed of stainless steel, ceramic, plastic, plywood, aluminum, steel plate and the like. The bar 1 may be colored in silver, white or gray, and it may be patterned with plain wood, wood grain, or metallic finish by painting. A battery receiving portion 2 is vertically provided in the bar 1 at a position lower than the upper end opening of the bar 1 in consideration of the size necessary for containing power source batteries 3. An entrance window 4 for an illuminator 5 is provided on a wall surface of the bar 1 at a position having a height of for example 30 cm from the lower end to be contacted with the ground. As shown in FIG. 3, the illuminator 5 includes a socket 7 for mounting an illuminating light source (white light) 6 and a reflection board 8 for collecting light emitted from the illuminating light source 6 to the entrance window 4. The socket 7 is connected to the power source batteries 3 by way of a lead wire W and a change-over switch SW (described later).

Figure 4:
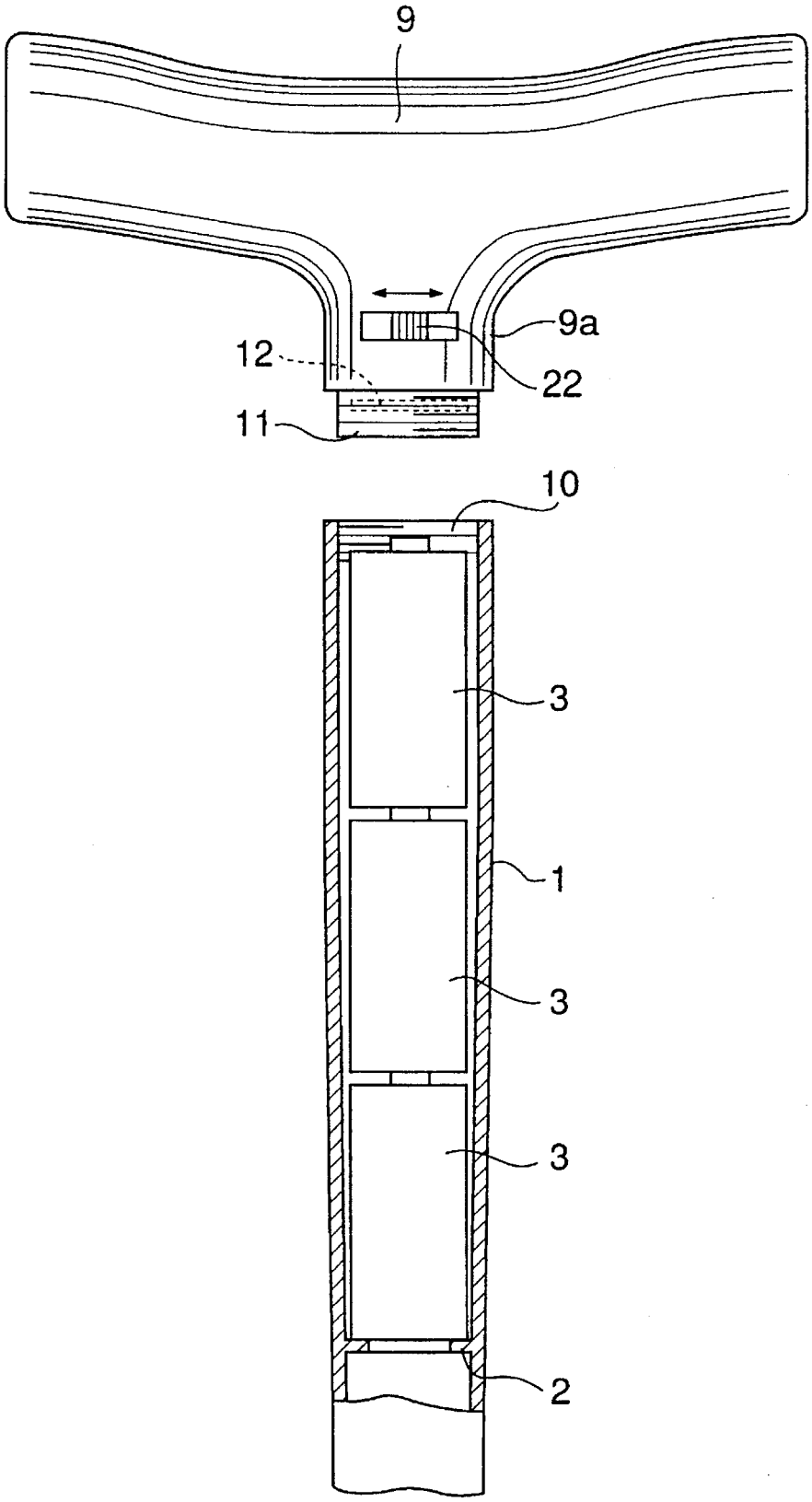
FIG. 4 is an enlarged sectional view of a battery containing portion.

The handle portion 9 is provided integrally with the bar 1 by screwing a thread portion 10 formed around the outer periphery of a connecting portion 9*a* of the handle portion 9 with a thread portion 11 formed around the inner periphery of the upper end opening of the bar 1. At this time, as shown in FIG. 4, the power source batteries 3 can be forcibly held without any clearance by pressing the power source batteries 3 onto the receiving portion 2 with a terminal plate 12 formed on the end surface of the connecting portion 9*a*.

A light diffusive lens 13 is mounted on a frame body 14, and is attached on the bar 1 by screwing a thread portion provided around the peripheral edge of the frame body 14 with a thread portion around the opening peripheral edge of the entrance window 4.

Figure 5:
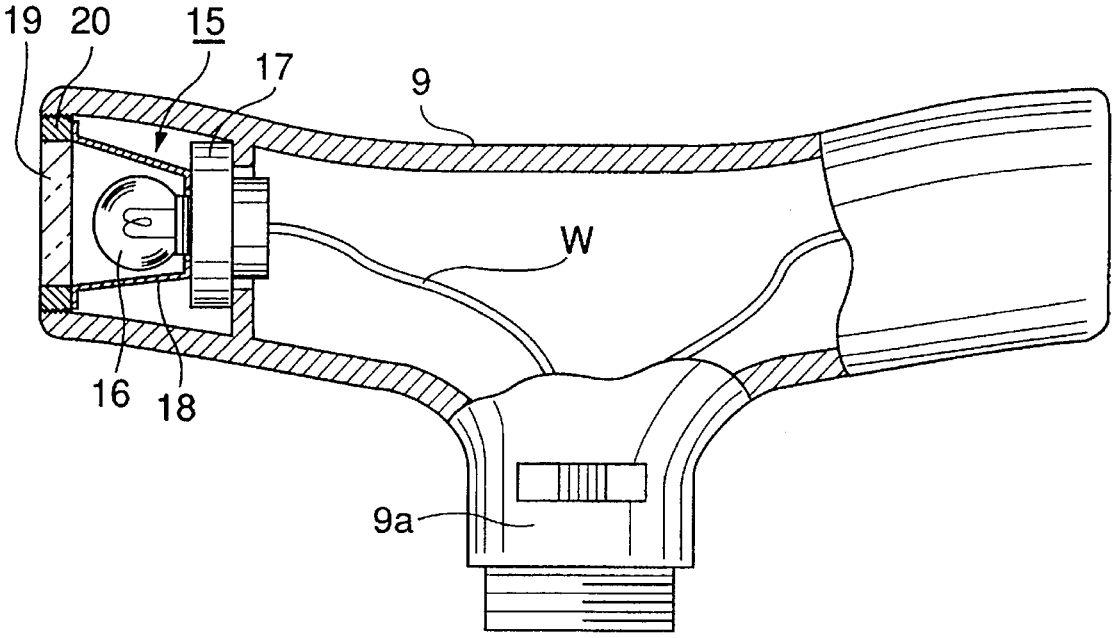
FIG. 5 is an enlarged view of a portion for mounting a warning light source.

An illuminator 15 is contained in the handle portion 9 from one end opening of the handle portion 9 and fixed therein. As shown in FIG. 5, the illuminator 15 includes a socket 17 for mounting a warning light source 16 (red light) and a reflection board 18 for collecting light emitted from the warning light source 16 to the opening portion. A light diffusive lens (transparent cover) 19 is mounted on a frame body 20, and is attached on the handle portion 9 by screwing a thread portion provided around the peripheral edge of the frame body 20 with a thread portion formed around the above-described opening peripheral edge.

Figure 6:
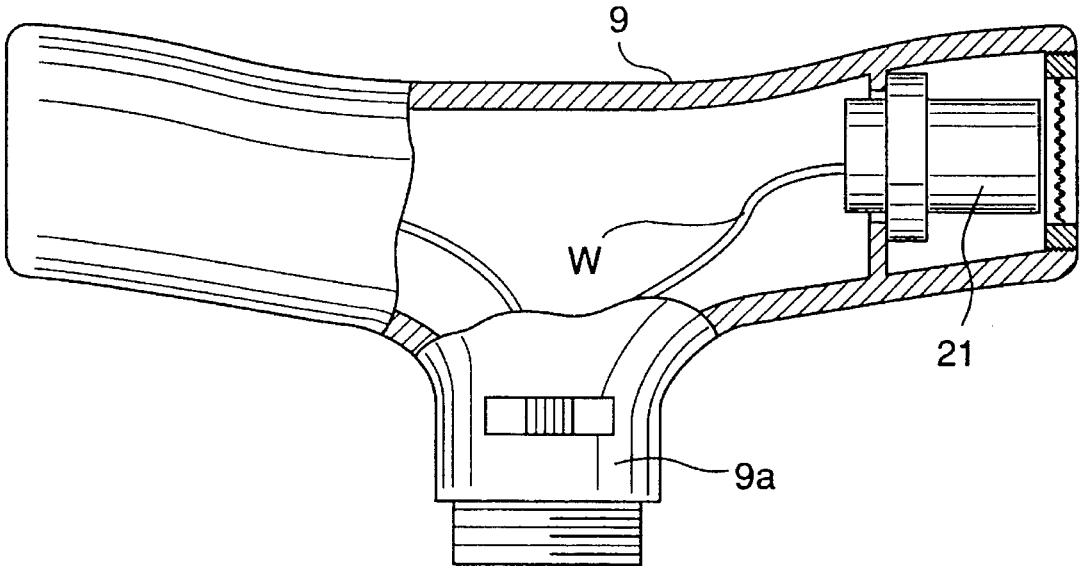
FIG. 6 is an enlarged sectional view of a portion for mounting an alarm.
Figure 7:
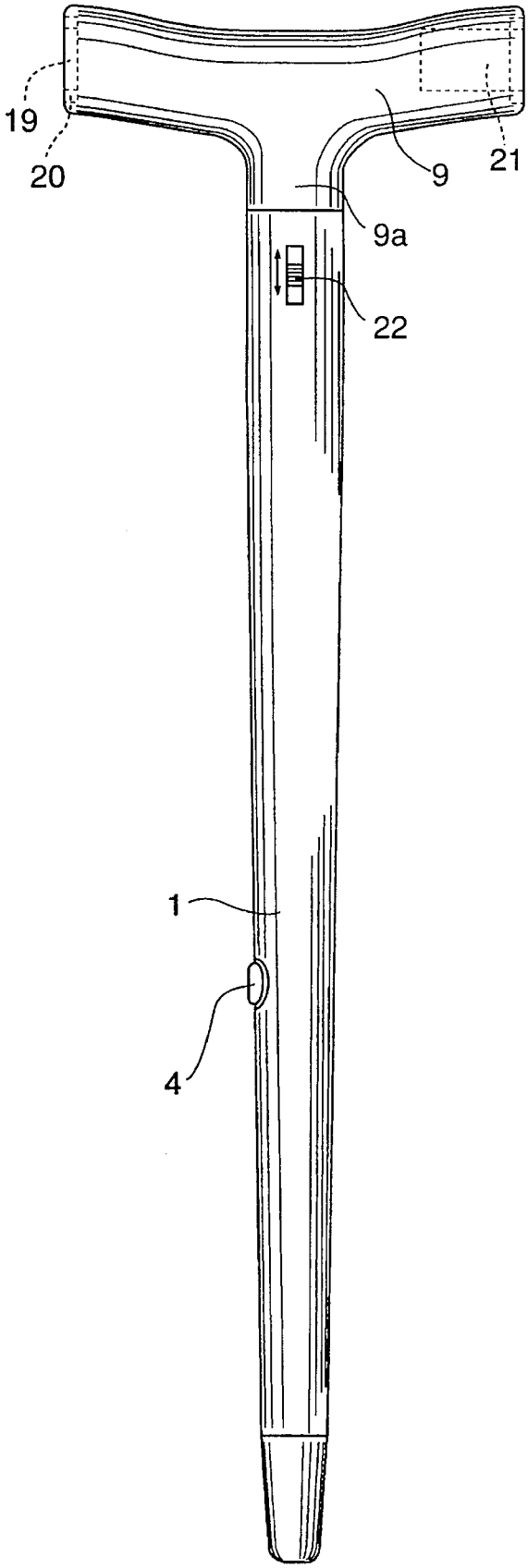
FIG. 7 is a view for illustrating the operating direction of a switch operating button.

An alarm 21 contains an alarm noise generating source, and as shown in FIG. 6, it is mounted in the handle portion 9 by screwing a thread portion formed on the outer surface of the alarm case with a thread portion formed around the opening peripheral edge at the other end of the handle portion 9. A switch operating button 22 is provided in the vicinity of the grip portion of the handle portion 9. The switch operating button 22 operates to open/close a feed line of a control circuit 23 for controlling the power source batteries 3, the light sources 6, 16, and the alarm 21.

Figure 8:
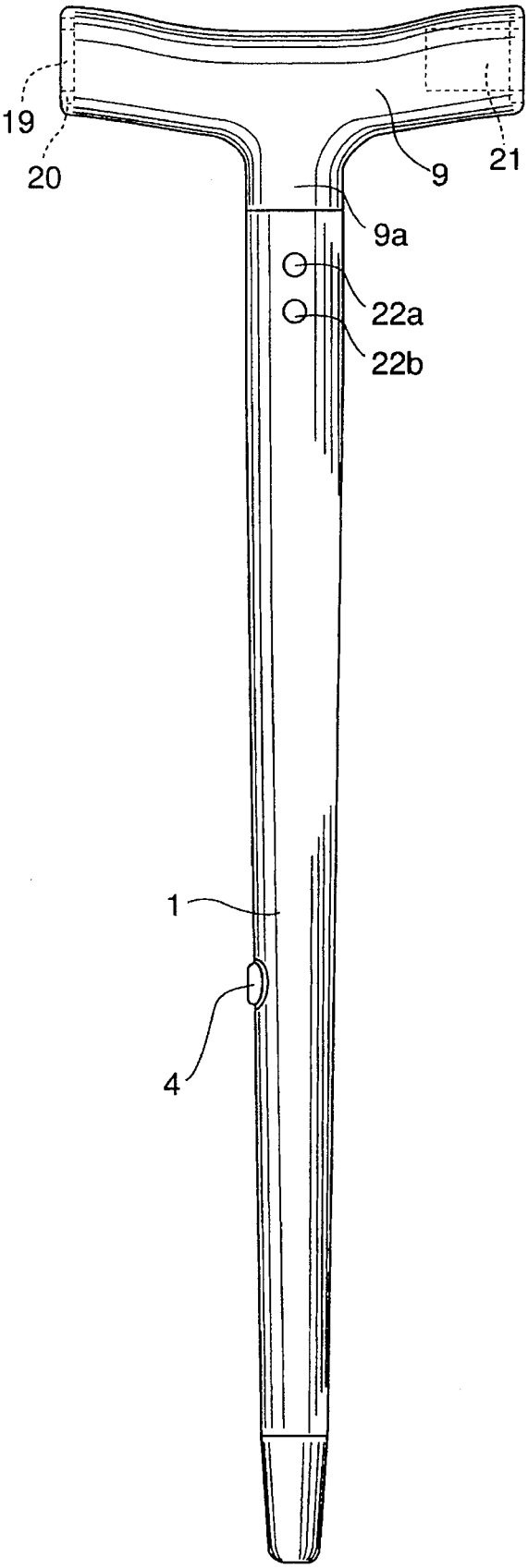
FIG. 8 is a view for illustrating the operational direction of switch operating buttons.

In this case, one piece of the switch operating button 22 may be slid transversely (see FIG. 1) or may be slid vertically (see FIG. 7); or two operating buttons 22*a*, 22*b* may be provided to be selectively used for opening/closing the feed line (see FIG. 8).

Figure 9:
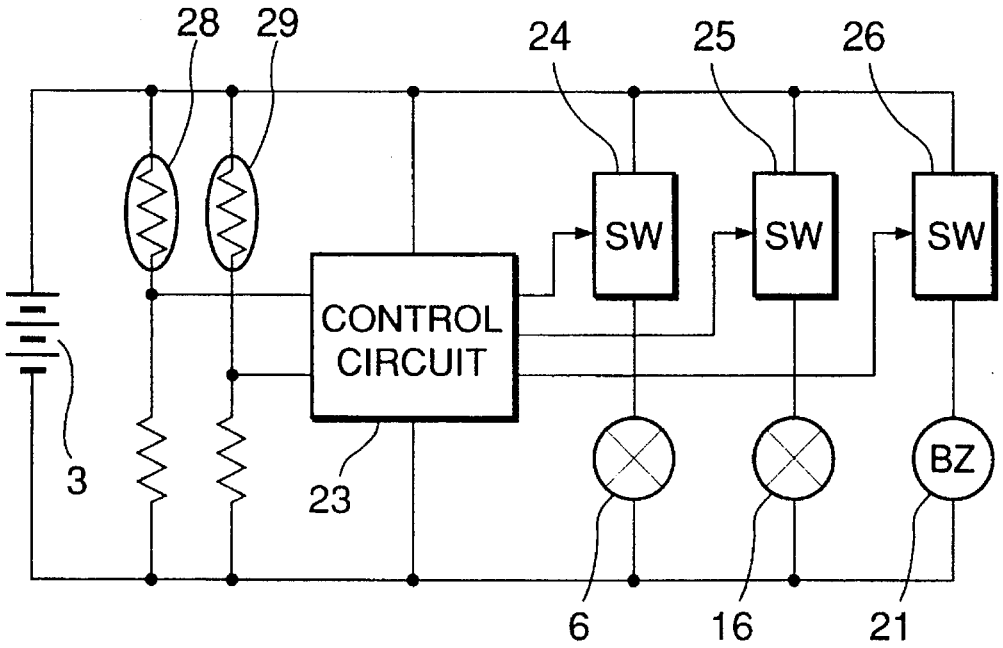
FIG. 9 is a circuit diagram showing one example of a power feed circuit.

FIG. 9 is a diagram showing one example of the above feed circuit. As the switch SW is changed-over by operation of the switch operating button 22, the input of the control circuit 23 is changed and thereby the output of the control circuit 23 is also changed, to thus suitably operate the light sources 6, 16 and the alarm 21.

The action of the stick in this embodiment will be described below. In the case where a user having the inventive stick walks in night, when the switch operating button 22 is operated to be turned in a first stage, a switching element 24 connected in series to the illuminating light source 6 is closed on the basis of a drive signal from the control circuit 23, thereby allowing the illuminating light source 6 to light up. The light passes through the light diffusive lens 13. An area having a length of about 3 mm ahead of the user is thus illuminated by the light. The user, therefore, can walk safely even in a dark road. At the same time, a switching element 25 connected in series to the warning light source 16 is closed on the basis of a pulsive drive signal from the control circuit 2, thereby allowing the warning light source to flicker. The flickering light passes through the light diffusive lens 19. An area ahead of the user is thus illuminated by the flickering light. Therefore, a driver in a car facing to the user can positively find the walker, to thus prevent the generation of an accident.

If the user meets with a danger or accident, he operates the switch operating button 22 in the vicinity of the handle portion to be turned in a second stage. With this operation, a switching element 26 connected in series to the alarm 21 is closed to activate the alarm 21, thus generating an alarm such as a siren, patrol car sound or words "Help me!" for avoiding the danger or accident.

Figure 10:
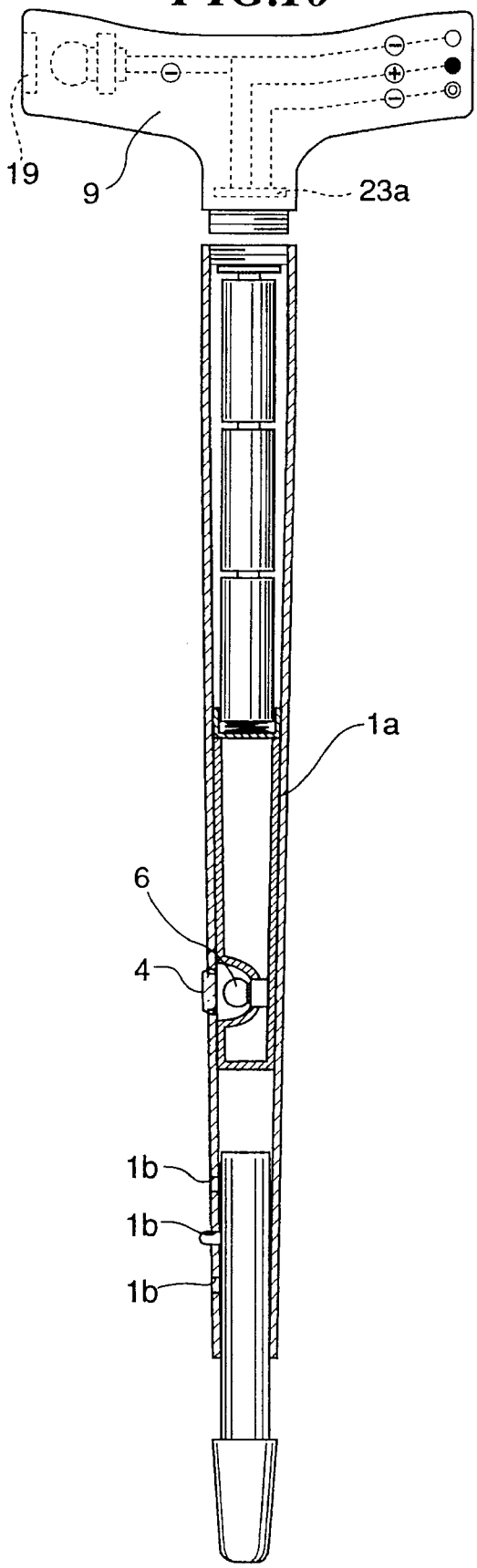
FIG. 10 is a side view showing a member for reinforcing the bar.

In this embodiment, since the handle portion 9 is screwed in the bar 1, it can be disassembled from the bar 1, with a result that the batteries 3 and the like can be easily mounted/dismounted. As shown in FIG. 10, a thick metal cylinder 1*a* may be provided in the bar 1 for connecting the circuits of the light sources 6, 19 with each other and also reinforcing the structure of the bar 1. Moreover, an IC (integrated circuit) 23*a* can be used as the control circuit 23.

To change the length of the bar 1 in accordance with the height of a user, adjustment buttons 1*b* for adjusting the height of the bar 1 simply and positively are formed on the lower portion of the bar 1 having a specified length so as to be spaced from each other at intervals of for example 5 cm (see FIG. 10).

Figure 11:
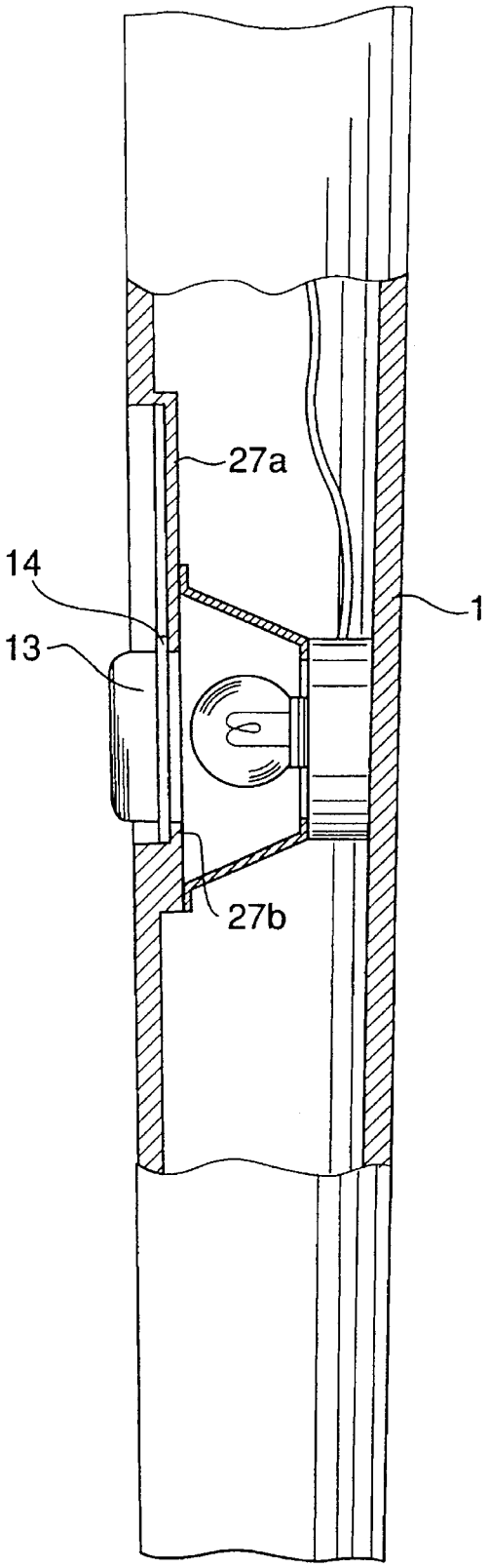
FIG. 11 is a vertical sectional view of a light diffusive lens mounting portion.
Figure 13:
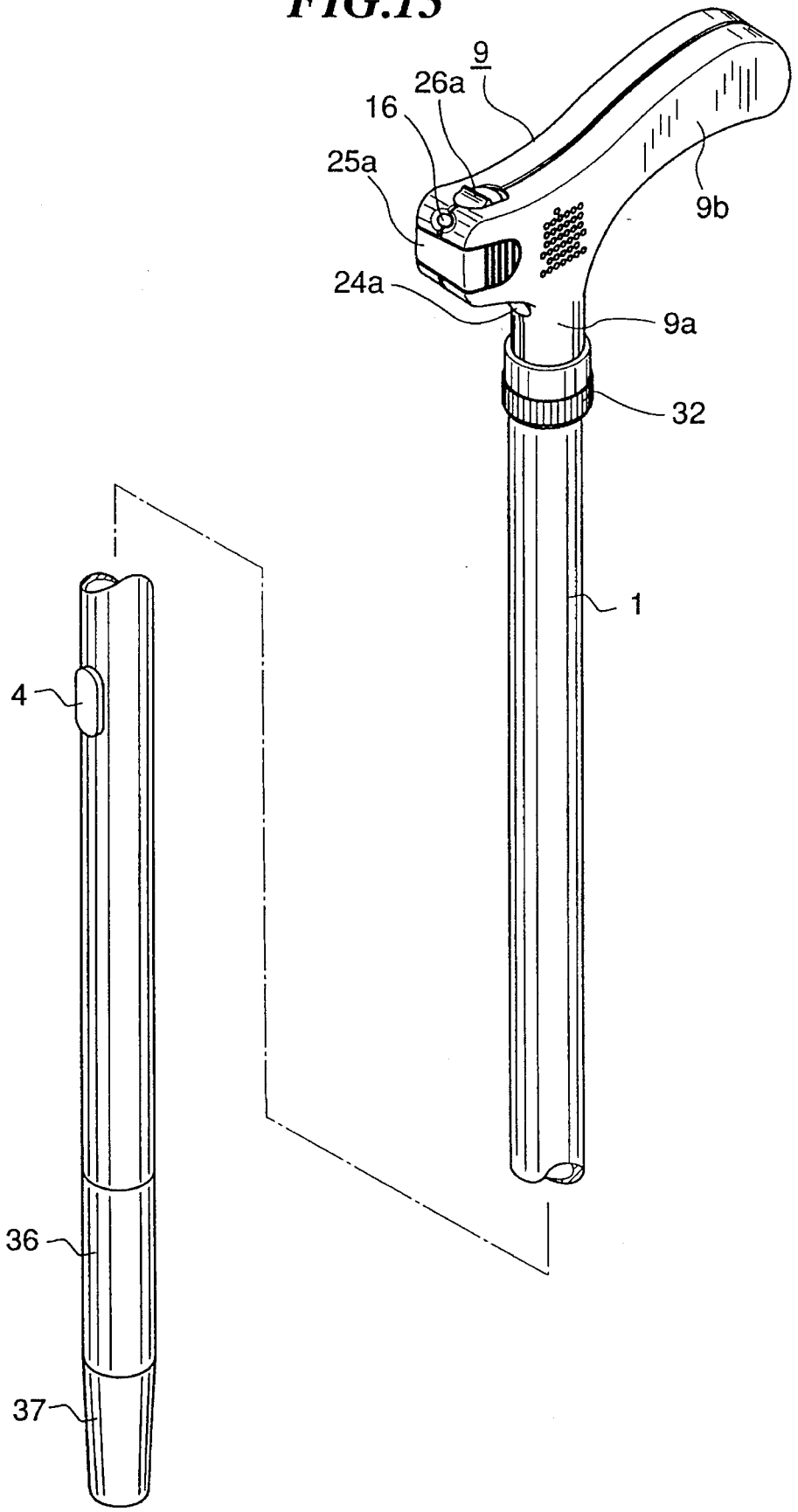
FIG. 13 is a perspective view, with parts partially omitted, of a stick according to another embodiment of the present invention.

In this embodiment, the frame bodies 14, 20 of the light diffusive lenses 13, 19 are screwed in the bar 1 and the handle portion 9, respectively; however, as shown in FIG. 11, stopper portions 27*a*, 27*b* may be provided in the bar 1 to be positioned on the upper and lower sides of the entrance window 14 respectively, and the frame body 14 may be vertically movably disposed between the stopper portions. With this construction, the entrance window 4 can be opened only by sliding upwardly the frame body 14 and thereby the illuminating light source 6 can be simply and rapidly exchanged.

In this embodiment, the feed line to the control circuit for controlling the illuminating light source 6, warning light source 16 and alarm 21 is opened/closed using the mechanical switches; however, in this case, there is a fear that the light sources 6, 16 cannot be lighted by an aged or disabled person who is difficult to positively operate the switch operating button 22.

Figure 12:
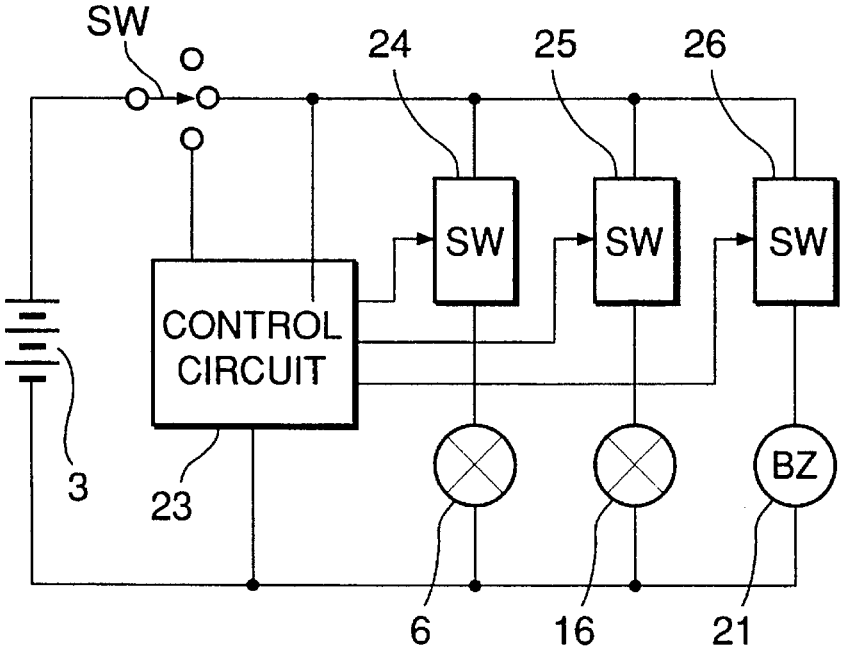
FIG. 12 is a circuit diagram showing another example of the feed circuit.

To cope with this problem, as shown in FIG. 12, there may be adopted a brightness sensor 28 (for example, CdS) for detecting the brightness range, and a sensible sensor 29 (for example, pressure sensor or thermostat) for detecting the fact that the user grasps the handle portion 9 for handling the stick on the basis of the body temperature or the grasping pressure of the user. The brightness sensor 27 detects the fact that the user uses the stick in night, and the sensible sensor 29 detects the fact that the user grasps the stick, that is, uses the stick.

The control circuit 23 may be so constructed that a drive signal from the control circuit 23 is output on the basis of an AND logic of each of the detected outputs from the sensors 28, 29. With this construction, the handling of the stick can be significantly improved. For example, in the case where the user grasps the stick in night, each of the light sources 6, 16 can be allowed to automatically light or flicker, and consequently, there is no problem even when the user forgets the operation of the switch operating button 22; and further, even when the user carelessly lights the light sources in day, the batteries can be prevented from being uselessly consumed. A vibration generating source (not shown) may be contained in the handle portion 9 in such a manner as to be interconnected with the lightening of the light source. With this construction, even when a blind person uses the stick, he can sense the lightening of the light source.

Although the description has been made using the cylindrical bar 1 in this embodiment, the bar 1 is not necessarily formed in the cylindrical shape. In this case, the bar 1 is formed with containing portions for the batteries and the illuminators, but it can be improved in strength. The handle portion 9 to be mounted at the upper end of the bar 1 is preferably formed in a size in accordance with that of the hand of a user; however, in general, it may be formed in a size ranging from 21 mm to 25 mm in diameter.

Next, another embodiment of the present invention will be described with reference to FIGS. 13 to 22. In this embodiment, parts being the same as or similar to those in the previous embodiment are indicated at the same characters and the overlapping explanation thereof is omitted.

In this embodiment, since a grip portion 9*b* of the handle portion 9 projects largely in back of the bar 1, to be thus easily grasped. The operating members 24*a*, 25*a*, and 26*a* for opening/closing the switching element 24 connected in series to the illuminating light source 6, the switching element 25 connected in series to the warning light source 16, and the switching element 26 connected in series to the alarm 21 respectively, and further the warning light source 16 are collected on the front portion of the handle portion 9, so that the three operating members are easier to be operated by the fingers of a hand grasping the rear side of the handle portion 9. In this case, the operating member 24*a* is laterally slid to opens/close the switching element 25; the operating member 25*a* is pulled in front of the handle portion to close the switching element 25; and the operating member 26 is rotated around a shaft 35 to opens/close the switching element 26.

Figure 15:
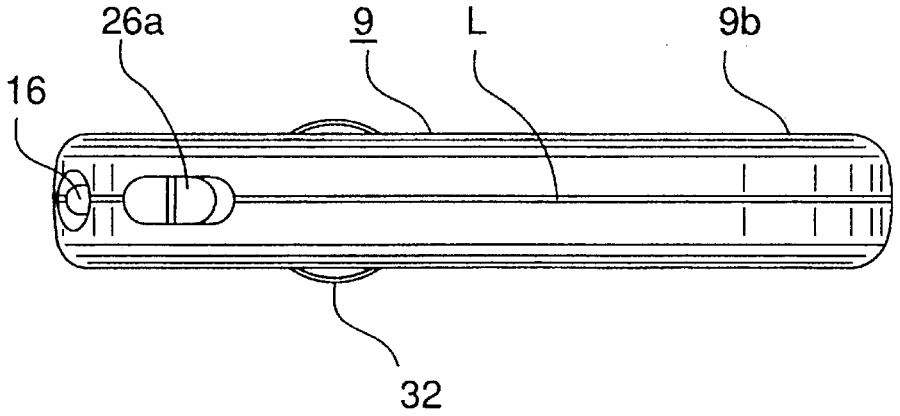
FIG. 15 is an enlarged plan view of the handle portion.
Figure 16:
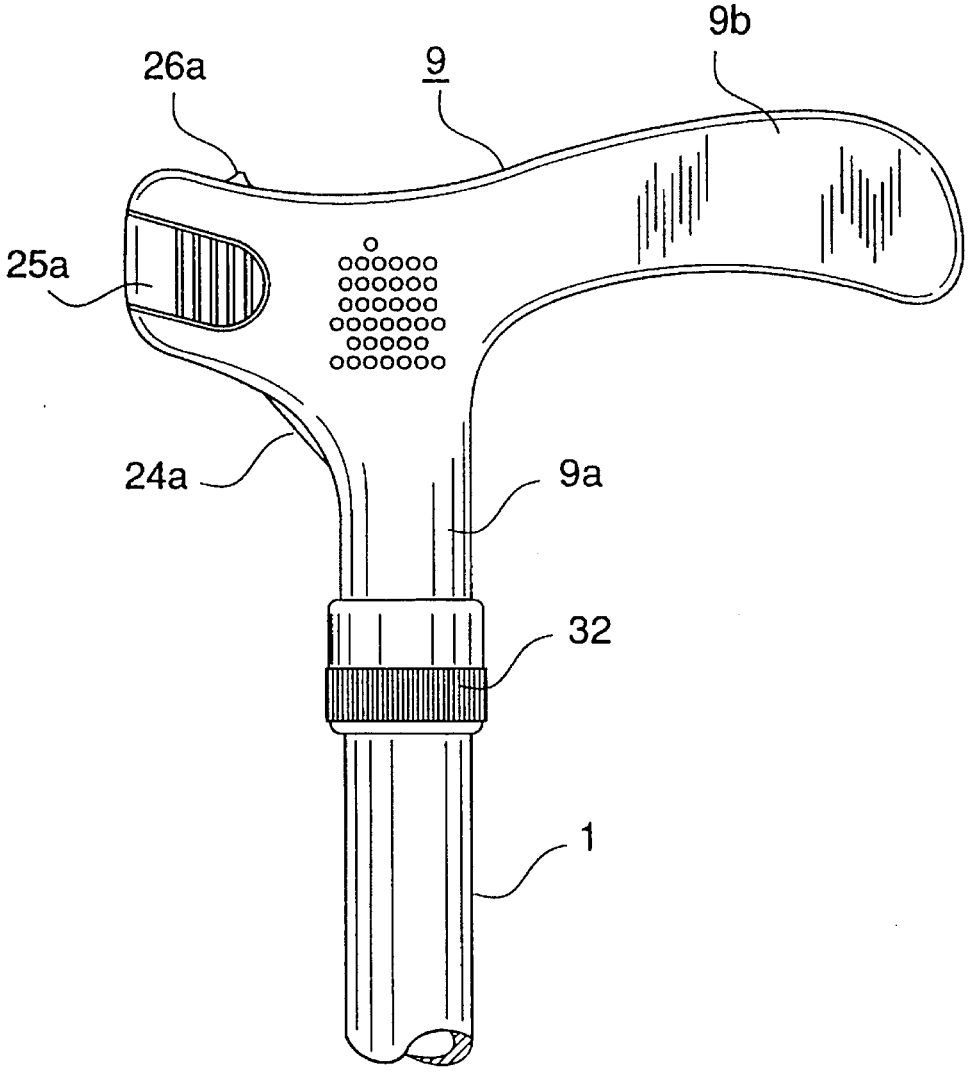
FIG. 16 is a side view of the handle portion.
Figure 17:
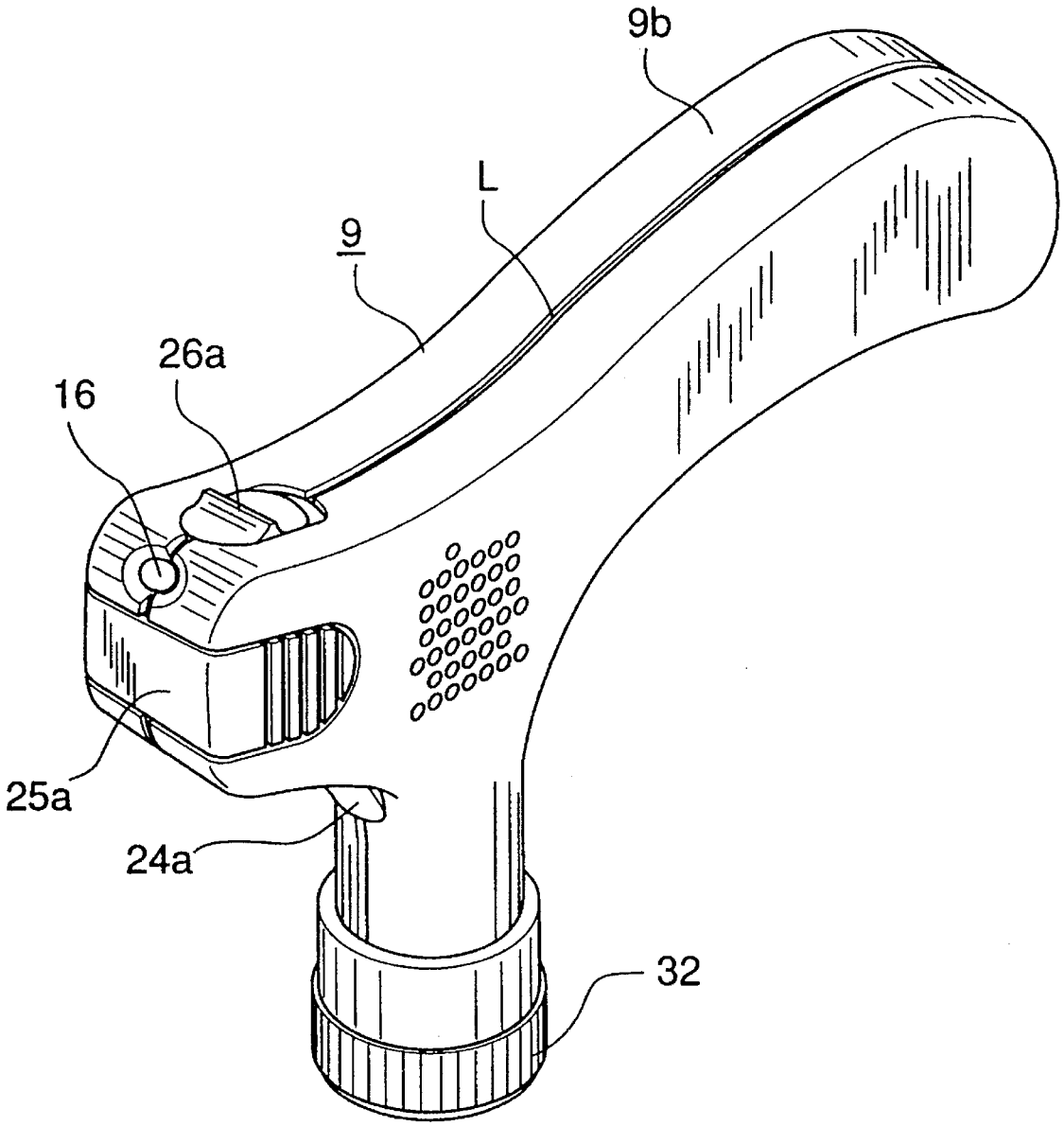
FIG. 17 is a perspective view of the handle portion.
Figure 18:
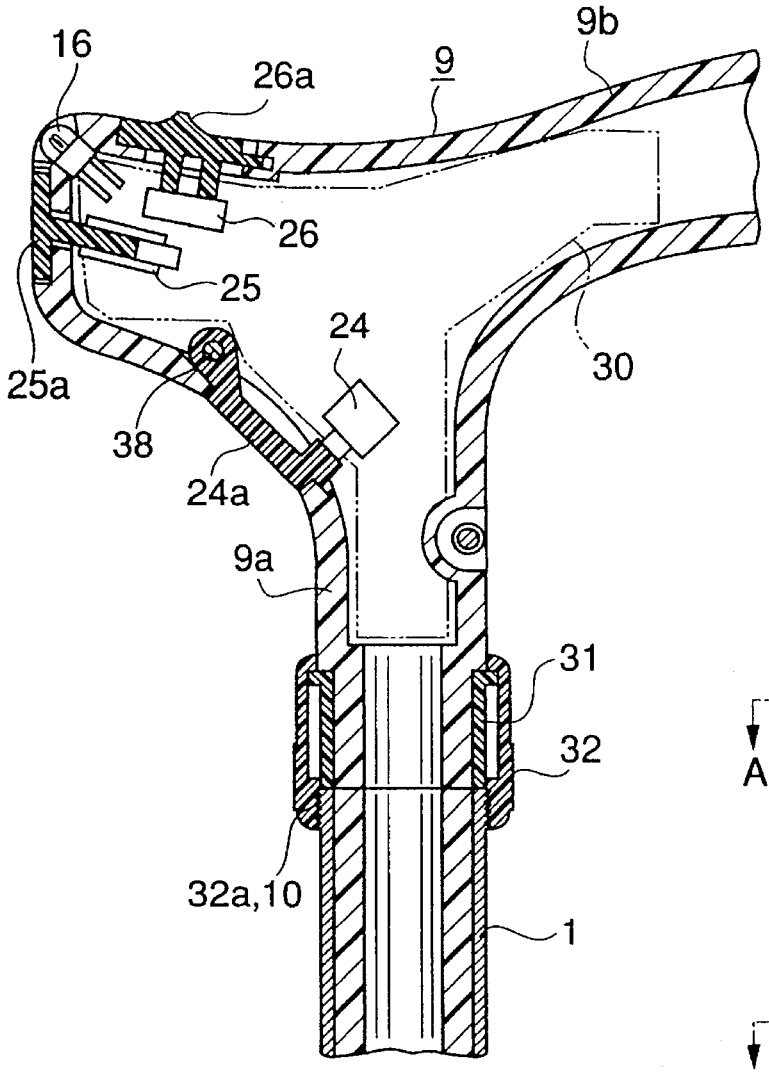
FIG. 18 is a side view showing the interior of one of the divided parts of the handle portion.

As shown in FIG. 18, the handle portion 9 can be divided into two parts along a line L shown in FIGS. 15 and 17. This makes it easy to mount/dismount the switching elements 24, 25 and 26 and a board 30 mounting the warning light source 16. As a result, the checking and the replacement of the switching elements 24, 25 and 26 and the warning light source 16 relative to the board 30 can be made easy.

Figure 19:
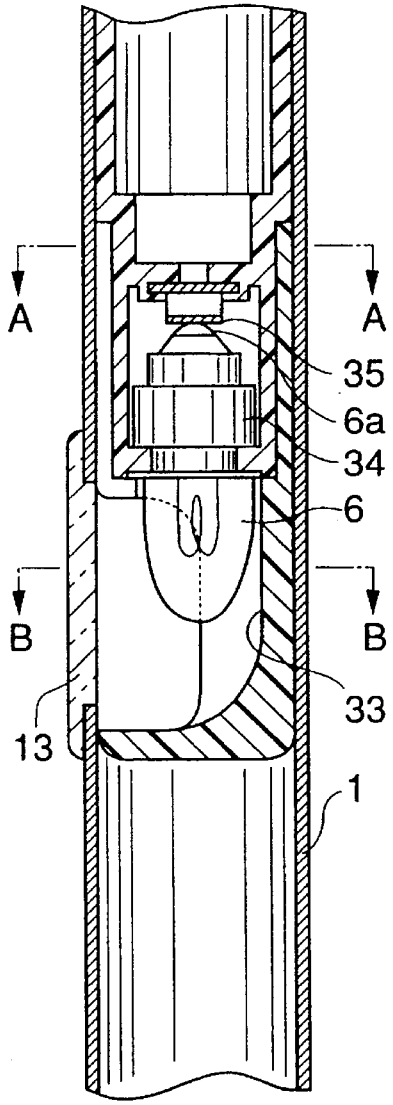
FIG. 19 is an enlarged sectional view of the illuminating light source containing portion of the bar.
Figure 20:
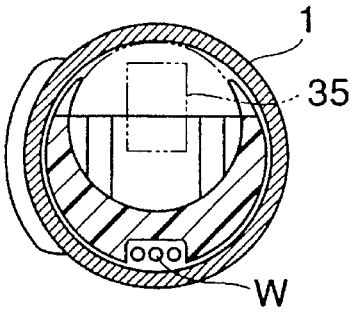
FIG. 20 is a transverse sectional view taken along line A—A of FIG. 19.

The handle portion 9 is so constructed as to be removably mounted at the upper end of the bar 1 using a fixed ring 31 and a fastening ring 32 shown in FIG. 19. The fixed ring 31 is fixed around the leading end of the connecting portion of the handle portion 9, and the fastening ring 32 is rotatably fitted to the outside of the fixed ring 31. A thread portion 32*a* on the inner surface of the fastening ring 32 is screwed with a thread portion 11 on the outer surface at the upper end portion of the bar 1 inserted in the fixed ring 31, and the fastening ring 32 is then rotated, as a result of which the bar 1 is pulled up by the fastening of the fastening ring 32 until the bar 1 abuts the fixed ring 31, the bar 1 being thus integrated therewith. In this case, the bar 1 is not rotated; accordingly, as shown in FIG. 20, there is generated no torsion of the lead wire W connecting the batteries 3 contained in the bar 1 to the electric parts provided in the handle portion 9.

Figure 21:
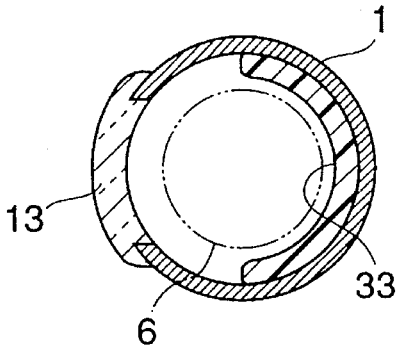
FIG. 21 is a transverse sectional view taken along line B—B of FIG. 19.

As shown in FIGS. 19 and 21, a light source guide surface 33 is formed in the bar 1 at the position facing to the light source entrance window 4 mounting the light diffusive lens 13, and a light source holding member 34 made of an elastic material or the like is provided at the upper end of the light source guide surface 33. Reference numeral 35 indicates a lamp contact piece provided at the lower end of the battery containing portion in the bar 1. A terminal 6*a* of the light source 6 inserted from the window 4 and press-fitted/held in the holding member 34 is press-contacted with the lamp contact piece 35, thus feeding a current to the light source.

Figure 14:
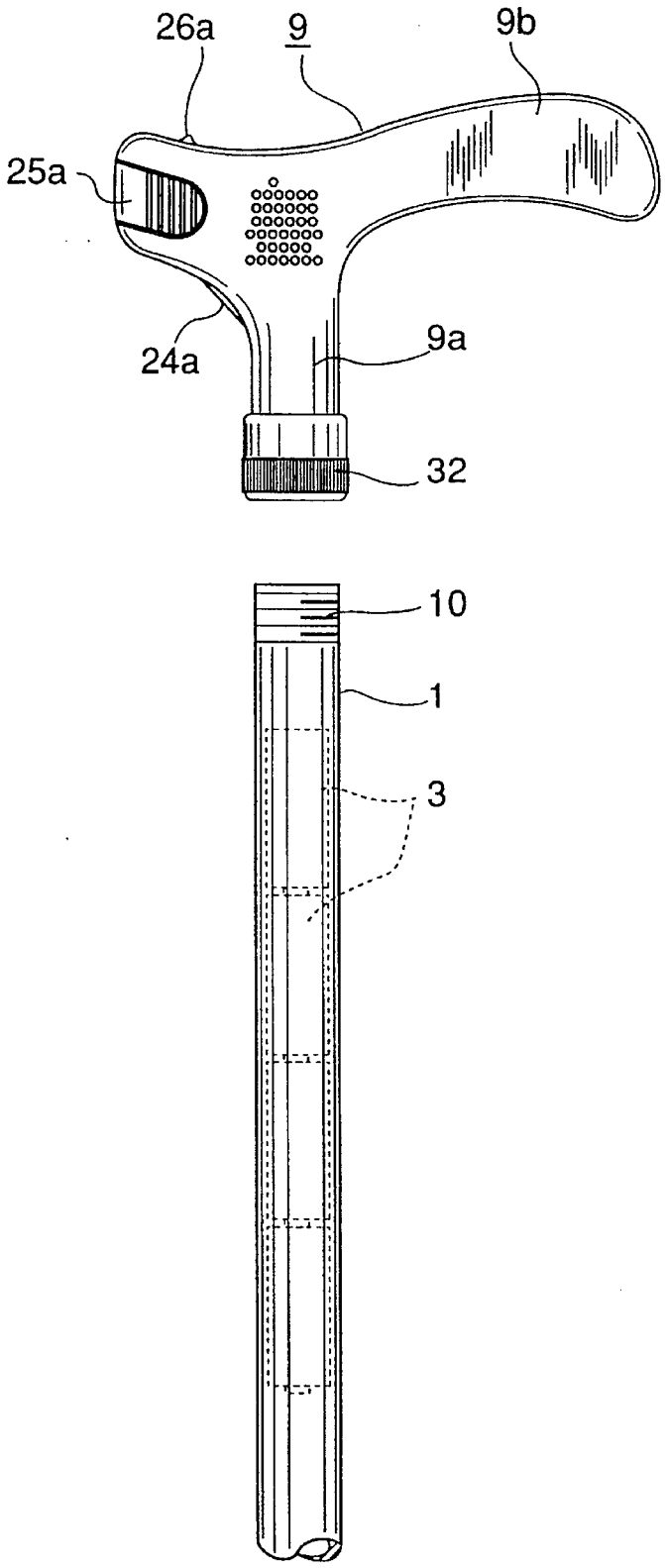
FIG. 14 is a side view showing the state that the handle portion is removed from the bar constituting the stick.

Four pieces of the batteries 3 are contained in the battery containing portion as shown in FIG. 14, and each pair of the batteries are alternately used by change-over of the battery circuit change-over switch (not shown). Accordingly, even when a pair of batteries are consumed, they can be changed-over to the other pair of the batteries, to avoid the unusable state of the stick due to the consumption of the batteries, thus improving the usability of the stick.

Figure 22D:
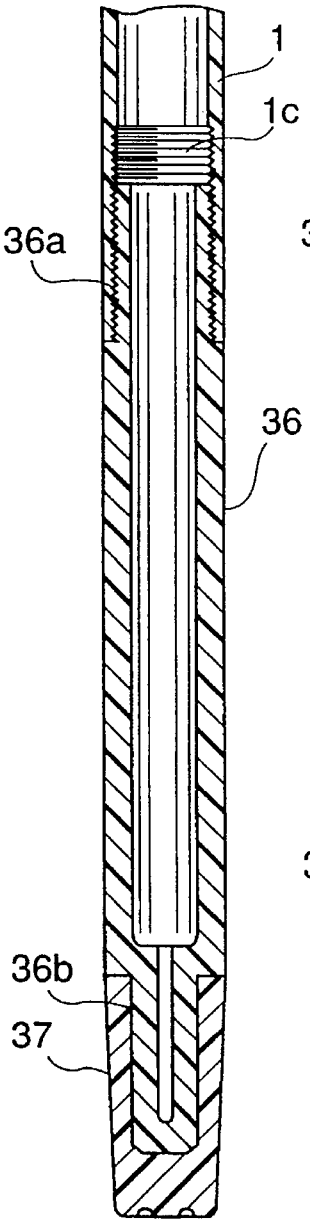
FIGS. 22(*a*) to 22(*d*) are front views of connecting members for changing the length of the bar.
Figures 22A, 22B, 22C:
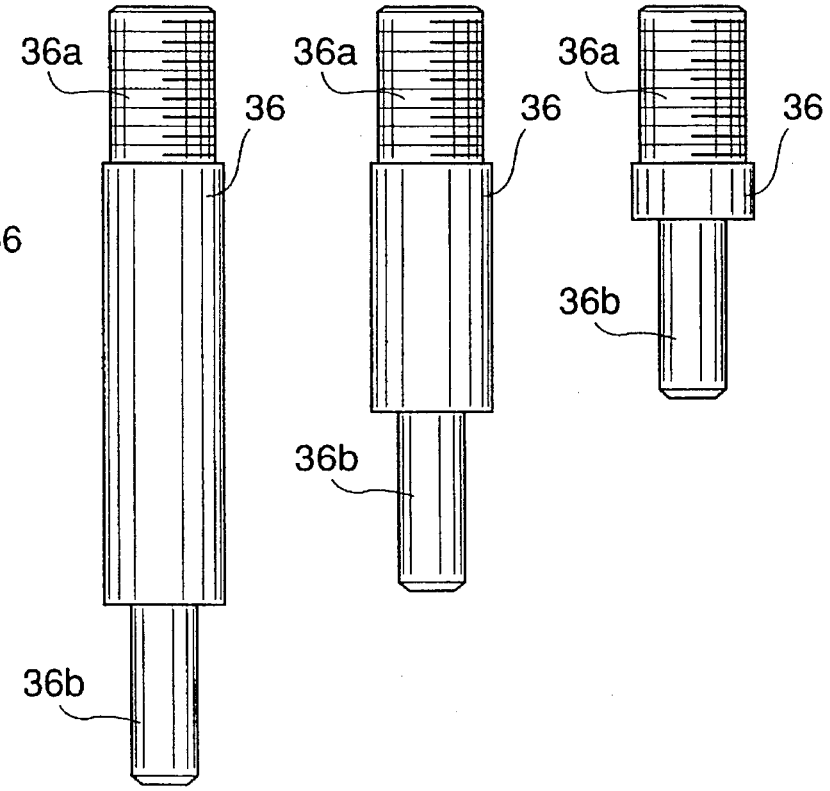

FIGS. 22(*a*) to 22(*d*) show connecting members 36 for changing the length of the bar 1: wherein FIG. 22(*a*) shows a S (small) size; FIG. 22(*b*) shows an M size; FIG. 22(*c*) shows an L size; and FIG. 22(*d*) shows an LL (longest) size. Even in the connecting member 36 with either of the sizes shown in FIGS. 22(*a*) to 22(*d*), the length of the upper end portion formed with a thread portion 36*a* mounted on the thread portion 1*c* at the lower end of the bar 1 is constant, and also the length of a lower end portion 36*b* for mounting a rubber foot 37 is constant. Accordingly, each of the bar 1 and the rubber foot 37 can be processed in a constant size, thus making easy the processing of the bar 1 and the rubber foot 37.

According to the present invention, an illuminating light source continuously lights and illuminates an area close to the feet of the user by way of a light diffusive lens, thereby allowing the user to easily walk in night; and the warning light source periodically flickers and gives attention to a driver, on a bicycle or in a car, facing to the user by way of a transparent cover, thereby allowing the user to walk safely along a dark road in night.

In the present invention, a handle portion is removably connected to the upper end of a bar by screwing a fastening ring rotatably formed on one of the handle portion and the upper end of the bar with a thread portion formed on the other of the handle portion and the upper end of the bar. With this construction, there is generated no torsion of a lead wire connecting batteries contained in the bar to electric parts provided in the handle portion because each of the bar and the handle portion is not rotated upon mounting/dismounting.

In the present invention, the handle portion is divided into two parts, whereby electric parts provided in the handle portion can be easily checked or exchanged.

In the present invention, a vibration generating source activated in interlocking with the lighting of each light source is provided in the handle portion. Accordingly, in the case where a blind person uses the stick, he can sense the lighting of the light source easily and positively.

In the present invention, there is provided an alarm whereby, when the user meets with a danger or accident upon walking in night, he operates the switch and activates the alarm, thereby simply and rapidly informing a third person of the generation of an emergency.

In the present invention, a switch operating button is provided in the vicinity of the handle portion of the bar usually grasped by the user in hand, whereby even when the user suddenly meets with a danger or accident, he positively operates the switch and activates the alarm, thereby informing a third person of the generation of an emergency; the illuminating light source is provided at a position having a specified height from the ground, whereby a specified area can be usually illuminated by the light from the illuminating light source; and a wide angle lens is used as the transparent cover of each light source, whereby the user can walk safely in night.

In the present invention, a drive signal is outputted from the control circuit on the basis of an AND logic of an output signal from each of a brightness sensor and a sensible sensor. With this construction, when the stick is used in night, both the illuminating light source and the warning light source are allowed to automatically light and flicker. As a result, the user can positively light the light sources only by grasping the stick, and therefore, this stick can be safely used for an aged or disabled person who is difficult to positively operate the switch operating button. In this stick, the power source battery can be prevented from being uselessly consumed due to the careless lighting of the light source in day. Moreover, since the stick does not any mechanical switch, the construction can be simplified.

What is claimed is:

1. A stick comprising a bar having a handle portion at an upper end of said bar, a power source battery contained in said bar, an illuminating light source connected to said power source battery for illuminating an area close to feet of a user having said stick, a warning source connected to said power source battery for drawing a third person's attention, a transparent cover disposed on a front surface of said illuminating light source, and a control circuit for supplying a drive signal to each of said sources by opening/closing a switch of a feed line from said power source battery, wherein a drive signal is output from said control circuit on the basis of an AND logic of an output signal from each of a brightness sensor for detecting a brightness range and a sensible sensor for detecting a user's body temperature.

2. The stick according to claim 1, including an alarm driven by a signal supplied from said control circuit.

* * * * *